United States Patent [19]

Haas

[11] Patent Number: 4,808,024

[45] Date of Patent: Feb. 28, 1989

[54] METHOD FOR INSTALLING A PAVEMENT UNDERDRAIN

[76] Inventor: Jon A. Haas, 38446 Valley Rd., Oconomowoc, Wis. 53066

[21] Appl. No.: 32,208

[22] Filed: Mar. 30, 1987

[51] Int. Cl.[4] ..... E01C 11/24

[52] U.S. Cl. ..... 404/2; 404/75

[58] Field of Search ..... 404/2, 3, 4, 5, 47, 404/71, 72, 74, 75; 175/22, 19; 405/36, 43, 45, 49, 184

[56] References Cited

U.S. PATENT DOCUMENTS

| | | | |
|---|---|---|---|
| 2,136,151 | 11/1938 | Parrish | 405/49 |
| 2,254,885 | 9/1941 | Carswell et al. | 404/2 |
| 2,680,416 | 6/1954 | Russell | 111/5 |
| 3,137,483 | 6/1964 | Zinkiewicz | 175/19 |
| 3,608,443 | 9/1971 | Gagle et al. | 404/4 |
| 3,656,563 | 4/1972 | Blinne | 175/22 |
| 3,712,187 | 1/1973 | Stelling | 404/3 |
| 3,791,752 | 2/1974 | Gardner | 404/2 |
| 3,837,413 | 9/1974 | Dunn | 175/292 |
| 3,902,563 | 9/1975 | Dunn | 175/62 |
| 3,976,578 | 8/1976 | Beane | 405/49 X |
| 4,067,200 | 1/1978 | Watts, Jr. et al. | 175/22 X |
| 4,124,082 | 11/1978 | Garver | 175/62 |
| 4,329,077 | 5/1982 | Bouplon | 403/287 |
| 4,366,846 | 1/1983 | Curati, Jr. | 404/2 X |

OTHER PUBLICATIONS

Public Works for Jul. 1976, vol. 107, No. 7, pp. 5, 38, 39.

Development of Guidelines for the Design of Subsurface Drainage Systems for Highway Pavement Structural Sections: Cedergren et al., Report No. FHWA-R-D-73-14.

*Primary Examiner*—Jerome W. Massie, IV

*Assistant Examiner*—Matthew Smith

*Attorney, Agent, or Firm*—Foley & Lardner

[57] ABSTRACT

A method for inhibiting roadbed erosion and damage to roadways utilizes an underdrain system for removing water which causes such damage. Underdrains in the form of perforate pipes, preferably covered with a geotextile sock as a filter, are disposed transversely to the lengthwise direction of the roadway in close proximity to faults, cracks, joints and other fissures in the roadway. The underdrains conduct water away from such fissures thereby preventing roadbed particulate material from being pumped upwardly through the fissures together with water which collects below the concrete roadway. Such an installation is highly useful for preventing further damage to existing roadways, and may be installed without interrupting traffic or destroying the road surface by means of a pneumatic underground piercing tool.

12 Claims, 2 Drawing Sheets

METHOD FOR INSTALLING A PAVEMENT UNDERDRAIN

FIELD OF THE INVENTION

This invention relates to the installation of drains beneath roadways for draining water, more particularly to the use of perforated underdrain pipes oriented transversely to a concrete roadway.

BACKGROUND OF THE INVENTION

It has been recognized that the action of water beneath roadways can cause erosion of the underlying roadbed and damage to the concrete roadway which often takes the form of irregular cracks in the concrete and pavement faulting (e.g. vertical displacement of the joints or cracks in Portland cement concrete pavements.) Such cracks often entered transversely to the lengthwise direction of the road. To combat the problem of water damage, a variety of pavement underdrain systems have been proposed. Some such systems involve elaborate networks of drainage conduits built into reinforced concrete or as part of the underlying roadbed. See, for example, Stelling U.S. Pat. No. 3,712,187 issued Jan. 23, 1973 and Gardner U.S. Pat. No. 3,791,752 issued Feb. 12, 1974. Such systems are elaborate, expensive and generally impossible to install (retrofit) to an existing roadway. As another means for protecting roadbeds from water seepage, the use of transversely oriented drainpipes beneath the road has been proposed, optionally in conjunction with an impermeable membrane underneath the soil adjoining the paving. See, for example, Gagle U.S. Pat. No. 3,608,443 issued Sept. 28, 1971, and Federal Highway Administration Report No. FHWA-RD-7314, Development of Guidelines for the Design of Subsurface Drainage Systems for Highway Pavement Structural Sections, February, 1973. The latter publication proposes one underdrain system including a series of perforated collector pipes ranged at intervals along the roadway beneath the open-graded road base. The pipes are disposed in individual trenches. A coarse filter material is packed around each collector pipe. The need for transverse drains on superelevated curves is emphasized. A collector pipe may be disposed in a trench to one side of the roadway for conducting water drained from the roadway. Another such drainage system is described in Public Works, Volume 107, No. 7, July, 1976, pages 38–39. Such systems are only partially effective for eliminating problems with pavement cracking due to water damage, and the methods proposed are labor-intensive.

More recently it has been recognized that the action of heavy vehicles on existing joints between pavement sections and road cracks may have a role in road damage. However, no prior drainage system for Portland cement roadways specifically addresses the problems created by the pumping action of passing vehicles. The present invention provides a retrofittable underdrain system which directly combats this problem, as explained in detail below.

A variety of systems have been described for tunneling beneath existing roadways and, in particular, installing transverse pipes under roadways without breaking the pavement surface. Many such systems involve borers or other heavy, elaborate equipment. See, for example, Dunn U.S. Pat. No. 3,837,413 issued Sept. 24, 1974, Dunn U.S. Pat. No. 3,902,563 issued Sept. 2, 1975, and Garver U.S. Pat. No. 4,124,082 issued Nov. 7, 1978, Blinne U.S. Pat. No. 3,656,563 issued Apr. 18, 1972 and Russell U.S. Pat. No. 2,680,416 issued June 8, 1954.

As an alternative to such methods, pneumatic ground piercing tools are now commonly employed for microtunneling, i.e. forming small, compacted transverse tunnels beneath roadways without breaking the road surface. The tool is a generally torpedo-shaped device having an internal piston or striker which reciprocates within the tool and drives it forward in the ground by successive impacts. See, for example, Zinkiewicz U.S. Pat. No. 3,137,483 issued June 16, 1964 as an example of one such impact-boring tool. Such tools have been used to install transverse metal pipes by means of a pipe-pushing adapter, such as described in Bouplon U.S. Pat. No. 4,329,077 issued May 11, 1982. Pipe-pulling devices for a similar purpose are also known. Such devices can include a special adapter which is coupled to the tailpiece of the ground piercing tool and the leading end of the pipe to be pulled through the ground. The hose supplying compressed air to the ground piercing tool is disposed inside of the pipe which trails along after the tool in the same manner as the air hose. Such pneumatic piercing tools, used in combination with a pipe pusher or puller, have been recently used to install pipes beneath roadways.

SUMMARY OF THE INVENTION

The present invention provides an underdrain system for preventing damage to pavement at or near fissures, i.e. joints or cracks, due to water in the roadbed beneath the pavement. According to this aspect of the invention, an underdrain in the form of a perforate pipe oriented generally transversely to the roadway is installed to prevent damage due to the pumping action of passing vehicles on the pavement sections and other forms of moisture-accelerated distress in concrete. The invention further provides a method of inhibiting erosion of the roadbed by installing such underdrain pipes.

According to an additional aspect of the invention, an underdrain may be installed beneath a roadway by a method including the steps of compacting particulate matter beneath the roadway proximal to a fissure, such as a joint of crack, to form a generally transverse, elongated tunnel beneath the roadway, and inserting into the tunnel a perforate underdrain pipe having filter means for selectively admitting water therein and conducting such water laterally out from under the roadway. This method is particularly carried out by pulling the underdrain pipe under the roadway using an impact-operated ground piercing tool which forms the tunnel by compaction.

BRIEF DESCRIPTION OF THE DRAWING

The invention will be described with reference to the accompanying drawing, wherein like numerals denote like elements, and.

DETAILED DESCRIPTION OF PREFERRED EXEMPLARY EMBODIMENTS

Figures 1, 2, 3, 7:
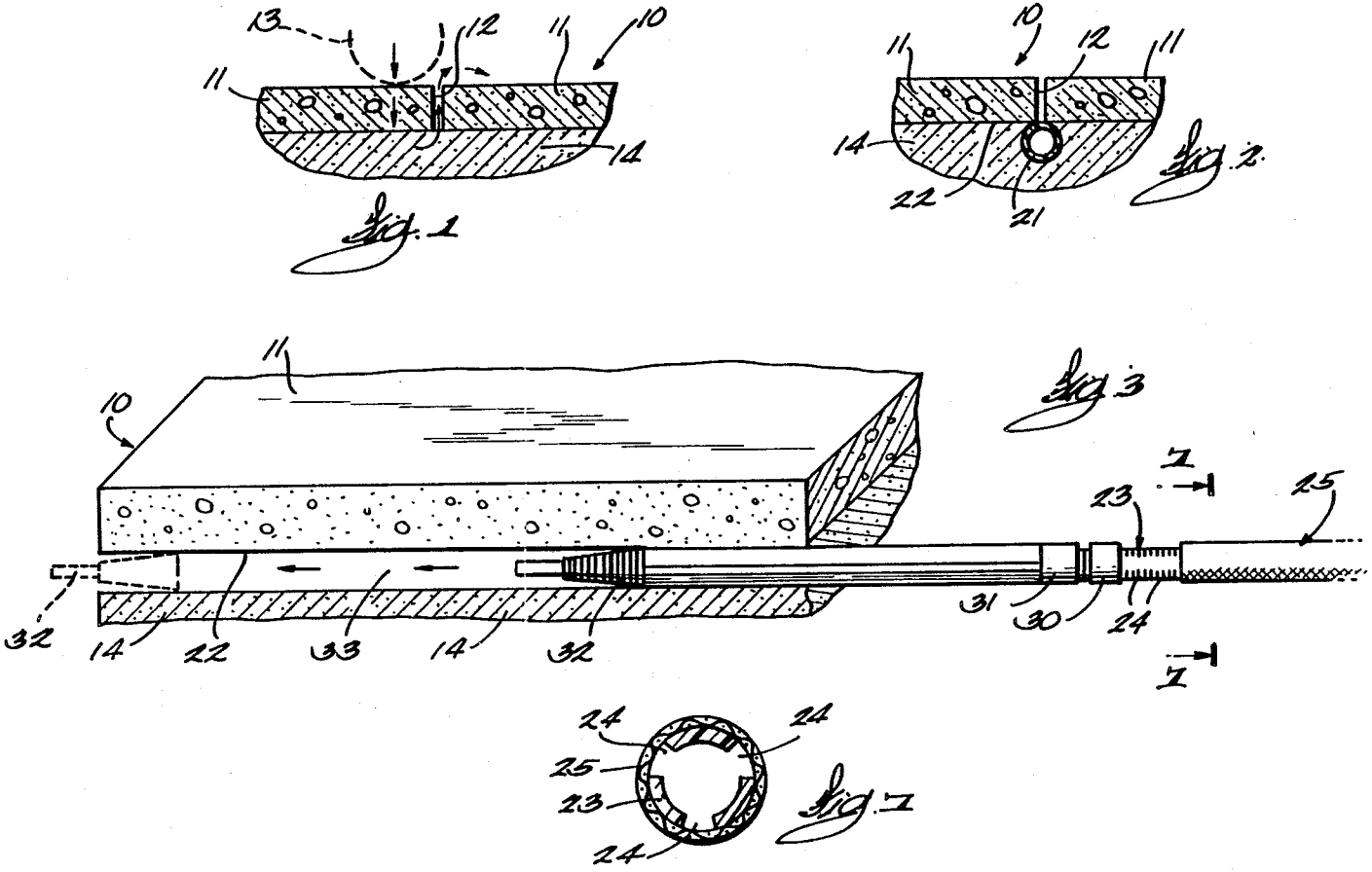
FIG. 1 is a schematic, cross-sectional view illustrating the water pumping action which occurs at fissures in conventional roadways.
FIG. 2 is a schematic, cross-sectional view of an underdrain installation according to the present invention.
FIG. 3 is a schematic illustration of a method of installing an underdrain according to the present invention.
FIG. 7 is a cross-sectional view taken along the line 7—7 in FIG. 3.

FIG. 1 illustrates the pumping action exerted on conventional roadway sections at a fissure. More particularly, a roadway 10 made of concrete, e.g. Portland cement, comprises a series of successive road sections 11 separated by transverse joints 12. As a truck or similar heavy vehicle passes over joint 12, moving from right to left in FIG. 1, tires 13 of such a vehicle exert a strong downward force on the edge of the associated road section 11, as illustrated by the downwardly directed arrows in FIG. 1. Water present in the roadbed 14 below the roadway 10 is pumped upwardly through joint 12, carrying with it particulate matter, i.e. sand, dirt, or other filler, from roadbed 14. The water and particulate matter move in a direction of the upwardly extending arrows in FIG. 1. The net result is a pumping action which successively undermines roadbed 14, eventually resulting in cracking of pavement sections 11. In the absence of such pumping action, water on the surface of roadway 10 tends to seep downwardly through joint 12 into roadbed 14. Thus, the water that causes the damage when heavy vehicles pass over the roadway naturally tends to collect at the sites where the damage is caused.

The underdrain system according to the present invention, and the method by which it is installed, are generally illustrated in FIGS. 2 through 7. To combat the problem of pavement damage caused by undermining of joints or cracks, a series of underdrains 21 comprising transverse, perforate pipes are positioned beneath and proximal to joints 12, as illustrated in FIG. 2. Underdrains 21 are preferably positioned in close proximity to joints or cracks 12, to stop the pumping cycle by diverting the flow of water. Underdrains 21 are preferably not more than 12 inches below the lower surface 22 of roadway 10, most preferably not more than about 4 inches below lower surface 22. Underdrains 21 are preferably centered beneath fissures (joints or cracks) 12, although precise alignment is not essential. Contrary to the prior art, transverse underdrains 21 should not be positioned in deep trenches beneath the roadway, since the water collects at fissures 12 and erosion of roadbed 14 occurs generally at the interface between roadbed 14 and roadway 10.

FIG. 3 illustrates a method for installing an underdrain 21 according to the invention. According to this preferred embodiment of the invention, underdrains 21 comprise a plastic slotted pipe 23 having radially spaced-apart, lengthwise rows of slots 24 along the length thereof, and a geotextile sock (sheath) 25 surrounding pipe 23. Sock 25 acts as a filter for preventing particulate matter from entering pipe 23 and clogging it. Alternatively, however, sock 25 may be omitted, and pipe 23 may have slots 24 which are sufficiently small to effectively prevent particles of dirt, sand, or the like from entering pipe 23. Underdrain 21 is secured by a coupling 30 to a corresponding tailpiece 31 of a conventional ground piercing tool 32.

To install underdrain 21, it is first necessary to dig a narrow trench, such as with a conventional trenching machine, by the side of roadway 10. The trench is oriented transversely to the lengthwise direction of roadway 10, and is deep enough to allow the ground piercing tool 32 to be positioned at an entry site directly below a fissure 12 in roadway 10. When in position, ground piercing tool 32 is positioned and turned on, whereupon it moves by successive impacts along a generally straight line beneath roadway 10. Since tool 32 operates by compaction rather than excavation, the method of the invention helps repair erosion which has occurred in roadbed 14 by compacting the roadbed 14 in the eroded area and installing underdrain 21 in the resulting tunnel 33. Ground piercing tool 32 continues to travel beneath roadway 10 until it emerges on the opposite side, thereby positioning underdrain 21 as desired beneath fissure 12.

Alternatively, coupling adapters 30, 31 may be dispensed with, and tool 32 may simply be used to form tunnel 33 without pulling underdrain 21. After tunnel 33 is completed underdrain 21 can be readily inserted manually if the diameter of tunnel 33 is sufficiently great, i.e. typically at least about one-half inch greater than the diameter of underdrain 21. However, the preferred method according to the invention is to pull the underdrain 21 into position at the same time as tunnel 33 is formed. This works out well in practice because underdrains are often installed during the day on heavily traveled highways. The passing of a heavy vehicle can cause tunnel 33 to fully or partly collapse. This is less likely to happen if underdrain 21 is installed at the same time as tunnel 33 is formed, as illustrated in FIG. 3. In general, the use of a pipe pusher, such as described in the Bouplon patent cited above, is not preferred because the flexible plastic pipe 23 generally does not have sufficient strength to withstand the frontal impacts from ground piercing tool 32.

Figure 4:
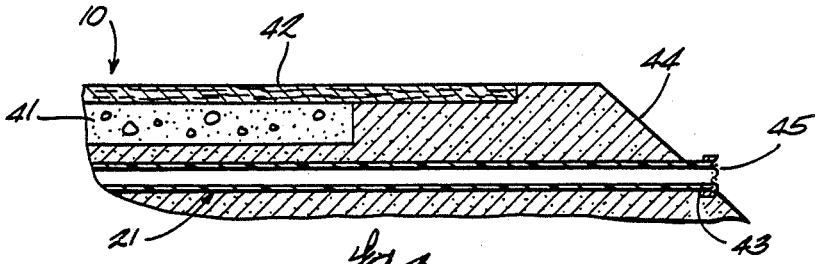
FIG. 4 is a schematic, cross-sectional view of an underdrain installation according to the invention.
Figure 5:
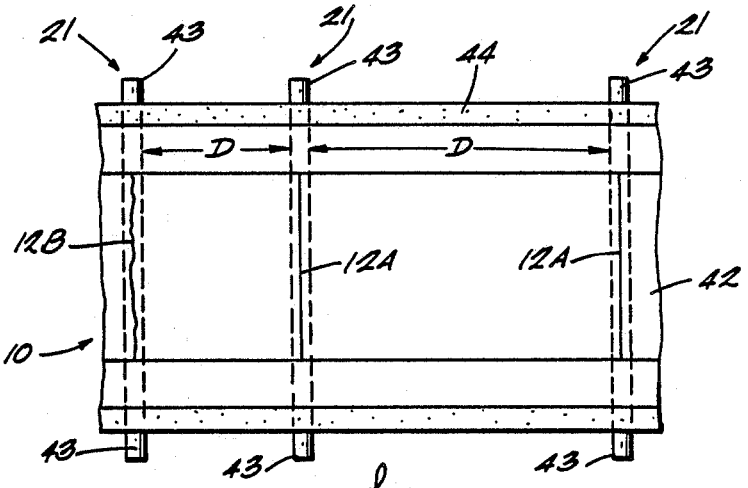
FIG. 5 is a top plan view of a series of underdrain installations beneath a roadway forming an underdrain system for the roadway.

FIGS. 4 and 5 illustrate an underdrain system according to the invention. In this illustrated embodiment, roadbed 10 comprises a slab of underlying concrete 41 and a layer of asphalt 42. A series of underdrains 21 are positioned beneath joints 12A and cracks 12B extending transversely along roadway 10. Each underdrain 21 has a pair of outfall outlets 43 at opposite ends thereof which open onto a sloping shoulder 44 of roadway 10, so that water which collects in underdrains 21 spills downwardly along shoulder 44 away from roadway 10. Wire screens 45 on outfall outlets 43 prevent animals from entering underdrains 21. Underdrains 21 are generally parallel to each other, and are spaced apart in the lengthwise direction of the road by distances D which vary depending upon the nature and position of joints 12A and cracks 12B. It may also be desirable to position additional underdrains 21 in positions intermediate fissures 12 if desirable for proper overall drainage.

Figure 6:
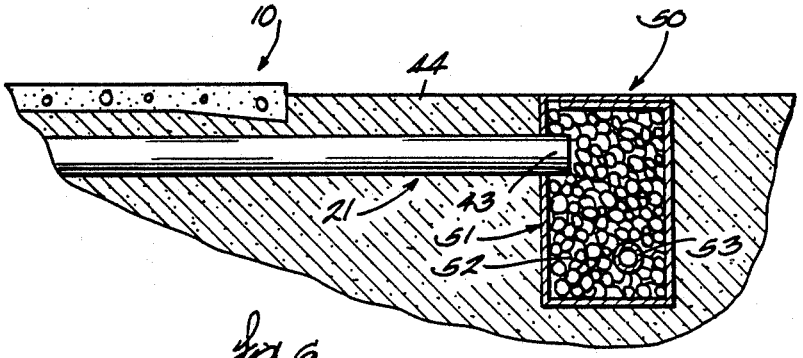
FIG. 6 is a cross-sectional view of a further embodiment of an underdrain system according to the invention.

FIG. 6 illustrates an alternative embodiment of the invention which is typically employed when roadway 10 lacks a convenient shoulder to allow the water to spill out. In such cases, it is necessary to dig a trench 50 along one or both sides of roadway 10. Underdrains 21 are installed so that the ends 43 thereof open into the resulting trench 50. The trench is then lined with a lining 51, and lining 51 is filled with a material through which water readily percolates, such as small stones or pebbles 52. Optionally, a perforate collector pipe 53 oriented parallel to the lengthwise direction of roadway 10 may be positioned within lining 51 and filler 52 for collecting water from each of the associated underdrains 21 and conducting it parallel to roadway 10 to an outlet (not shown) at which the water can conveniently be released without damaging roadway 10. If such a pipe 53 is used, lining 51 may be made of a plastic sheet impervious to water. In the alternative, if pipe 53 is omitted, then lining 51 may be made of a moisture pervious geotextile for allowing water from the road to percolate into the ground well beneath and to the side of the compacted roadbed. Such a lining 51 and filler 52 disposed in trench 50 comprise a means for distributing the water from underdrains 21 to the soil. Trench 50 may be filled or covered so that the entire system is buried. In the embodiment shown in FIG. 6, underdrains 21 are positioned several, i.e. 2 to 4 inches below undersurface 22 of concrete roadway 10.

In general, underdrains 21 may be relatively small, e.g. less than 4 inches in diameter, particularly 2 to 3 inches in diameter. Underdrains 21 having diameters of 3 inches or less are readily installed and are preferred over larger underdrains which require correspondingly greater effort to install. Pipes 23 are conveniently made of PVC or polyethylene. A preferred embodiment of the invention employs PVC pipe conforming to the requirements of ASTM D-1785. Outfall outlets of underdrains 21 are protected by screens 45 preferably made of galvanized 3/8 inch mesh screen. The geotextile filter fabric sleeve covering the plastic pipe 23 is advantageously made of a knitted polyester, having a water flow rate of at least about 500 gallons per minute per square foot of fabric. In a typical installation, an underground piercing tool having a diameter of 3.2 inches was used to install an underdrain having a 2 inch I.D., and a tool having a 4.0 inch diameter was used for a 3 inch I.D. underdrain 21.

Slots 24 in pipe 23 preferably have a width of 0.15 inch or less and have lengths so as to provide at least about 2 square inches of slot opening per linear foot of pipe 23. Rows of slots 24 are spaced such that each linear foot of pipe 23 preferably has at least about 20 slots 24. The foregoing materials and specifications have found to provide excellent results in practice, with minimum expense.

It will be understood that the above description is of preferred exemplary embodiments of the invention, and that the invention is not limited to the specific form shown. For example the underdrains need not extend all the way across the roadway; deadend underdrains having only one outfall opening can be employed. For a divided highway, an extralong underdrain can extend under both roadways and the island therebetween thereby draining the island as well. The term "roadway" as used herein includes all systems on which vehicles travel, e.g. paved air strips and railroad tracks. These and other modifications may be made in the design and arrangement of the elements without departing from the scope of the present invention as expressed in the appended claims.

I claim:

1. A roadway underdrain system, comprising a plurality of perforate underdrain pipes disposed generally transversely relative to the lengthwise direction of a roadway in spaced-apart, generally parallel positions along the length of the roadway, said underdrain pipes being disposed within about 4 inches of fissures in the roadway for collecting water from such fissures and conducting such water out from under the roadway, each of said underdrains having filter means for admitting water therethrough into said underdrains and for preventing particulate matter capable of clogging said underdrains from entering said underdrains.

2. The system of claim 1, wherein said roadway comprises a series of road sections made of concrete, and said underdrain pipes are positioned at joints between said road sections.

3. The system of claim 1, further comprising water distributing means adjoining outfall outlets of said underdrains for dispersing water therefrom.

4. The system of claim 3, wherein said water distributing means comprises a trench lined with a moisture pervious lining and filled with a material through which water percolates.

5. The system of claim 4, wherein said filled trench extends parallel to the roadway along one side thereof.

6. The system of claim 1, wherein said underdrain further comprises a non-corrugated pipe having radially extending slots along the length thereof for admitting water into the interior of said pipe, and said filter means comprises a geotextile sock disposed on the outside of said pipe over said slots.

7. A method for installing an underdrain in a roadbed beneath a fissure in an existing roadway, comprising:

positioning a ground piercing tool at an entry site in said roadbed at one side of said roadway;

driving said ground piercing tool beneath said roadway to compact particulate matter in said roadbed from the path of said ground piercing tool and thereby form an elongated tunnel beneath said roadway proximate said fissure, which tunnel extends generally transversely to said roadway; and inserting an underdrain into said tunnel, which underdrain collects water from said roadbed and conducts said water out from under said roadway, said underdrain having filter means for admitting water therethrough and into said underdrain while preventing particulate matter capable of clogging said underdrain from entering said underdrain, wherein said underdrain is positioned within about 12 inches of said fissure.

8. The method of claim 7, wherein said underdrain is installed within about 4 inches of said fissure.

9. The method of claim 7, wherein said ground piercing tool is a pneumatic, impact-operated ground piercing tool.

10. The method of claim 9, wherein said inserting step further comprises pulling said underdrain having said filter means into said tunnel with said ground piercing tool during said driving step.

11. The method of claim 7, wherein said underdrain further comprises a pipe having radially extending slots along the length thereof for admitting water into the interior of said pipe, and said filter means comprises a geotextile sock disposed on the outside of said pipe over said slots.

12. A method for inhibiting erosion of a roadbed made of particular material beneath a concrete roadway, which comprises installing an underdrain in said roadbed generally transversely to the lengthwise direction of said roadway at a position within about 4 inches of a fissure in said roadway to collect water from said roadbed and conduct such water out from under said roadbed, and to inhibit pumping of particulate roadbed material and water through said fissures, said underdrain having filter means for admitting water therethrough into said underdrain and for preventing particulate matter capable of clogging said underdrain from entering said underdrain.

* * * * *